United States Patent [19]

Pinnow et al.

[11] 3,957,544

[45] May 18, 1976

[54] FERRITIC STAINLESS STEELS

[75] Inventors: Kenneth E. Pinnow; Jerome P. Bressanelli, both of Pittsburgh, Pa.

[73] Assignee: Crucible Inc., Pittsburgh, Pa.

[22] Filed: Aug. 19, 1974

[21] Appl. No.: 498,700

Related U.S. Application Data

[62] Division of Ser. No. 233,441, March 10, 1972, abandoned.

[52] U.S. Cl. ..... 148/34; 29/196.1; 75/125; 75/126 C; 75/126 D; 75/126 F; 75/126 H; 75/126 J; 75/128 B; 75/128 G; 75/128 N; 75/128 T; 75/128 W

[51] Int. Cl.[2] ..... C22C 38/26; C22C 38/28

[58] Field of Search ..... 75/125, 126 C, 126 D, 75/126 F, 126 J, 126 H, 128 N, 128 G, 128 T, 128 W, 128 B; 29/193, 196.1; 148/34, 37; 138/178

[56] References Cited

UNITED STATES PATENTS

| | | | |
|---|---|---|---|
| 2,080,001 | 5/1937 | Becket | 75/126 R |
| 2,113,937 | 4/1938 | Franks | 75/126 R |
| 2,597,173 | 5/1952 | Patterson | 75/126 C |
| 2,624,671 | 1/1953 | Binder | 75/126 C |
| 3,723,101 | 3/1973 | Hunt | 75/126 R |
| 3,759,705 | 9/1973 | Chalk | 75/126 D |
| 3,807,991 | 4/1974 | Gregory | 75/126 F |

OTHER PUBLICATIONS

"Titanium and Columbium in Plain and High Chromium Steels" The Iron Age, Oct. 26, 1973, pp.20–22.

*Primary Examiner*—L. Dewayne Rutledge
*Assistant Examiner*—Arthur J. Steiner

[57] ABSTRACT

The present invention relates to high chromium ferritic stainless steels and more particularly to improving their chloride stress corrosion cracking resistance and weldability.

6 Claims, No Drawings

FERRITIC STAINLESS STEELS

This application is a division of application Ser. No. 233,441, filed Mar. 10, 1972, now abandoned.

The conventional ferritic stainless steels, particularly those containing more than about 20% chromium, have excellent resistance to pitting in a wide variety of corrosive environments and are generally considered virtually immune to chloride stress corrosion cracking. However, in some environments they have not been as resistant to chloride stress corrosion cracking as commonly assumed. Furthermore, they have relatively poor notch toughness at ambient temperature and are highly susceptible to embrittlement and intergranular corrosion after welding or service at elevated temperatures. These drawbacks have greatly limited their application.

Recent studies on lower chromium ferritic stainless steels, e.g. less than about 20% chromium, show that certain elements, such as copper, nickel, and cobalt, significantly reduce their chloride stress corrosion resistance. The acceptable maximum levels of copper, nickel and cobalt reported for these steels are well above normal residual levels; thus the commerical ferritic stainless steels with about 17 or 18% chromium and having copper, nickel and cobalt in residual amounts generally exhibit good resistance to stress corrosion cracking. It has now been discovered that for the high chromium ferritic stainless steels, e.g. chromium of about 20% or more, the maximum tolerable amounts of copper and nickel are much lower than reported for the lower chromium ferritic stainless steels and well below normal residual levels, especially for materials in the cold-worked condition. In addition it has been discovered that molybdenum, which increases the resistance of the high chromium ferritic stainless steels to pitting, also increases their tolerance for nickel and copper in regard to chloride stress corrosion cracking in the cold-worked condition.

A primary object of the present invention is, therefore, to provide high chromium ferritic stainless steels with superior resistance to chloride stress corrosion cracking, especially in the cold-worked condition.

Lowering the carbon and nitrogen contents of the high chromium ferritic stainless steels is known to substantially improve their notch toughness and resistance to embrittlement and intergranular corrosion after welding or heat treatment. U.S. Pat. No. 2,624,671 shows that alloys with chromium contents from 25 to 30% are relatively tough if the total carbon plus nitrogen content is below about 0.025%. However, still lower carbon and nitrogen contents on the order of 0.003% each of carbon and nitrogen appear needed to eliminate the susceptibility to intergranular corrosion. Production of the high chromium ferritic stainless steels at these levels of carbon and nitrogen is extremely difficult, and the required processes are currently impractical or very costly.

Titanium or columbium stabilization is another effective method for reducing the susceptibility of the high chromium ferritic stainless steels to intergranular attack. Moreover, stabilization appears more practical and economical than lowering carbon and nitrogen contents since it is effective at carbon and nitrogen levels obtainable by conventional melting and refining methods. However, as is well known, titanium or columbium stabilization of these steels can reduce surface quality, weldability, corrosion resistance, and other important properties. It has now been discovered in accordance with this invention that these disadvantages can be overcome by controlling the composition of the stabilized high chromium ferritic stainless steels, in particular carbon and nitrogen content, within certain critical composition ranges.

A further object of the present invention is, therefore, to provide stabilized high-chromium ferritic stainless steels with superior surface quality, weldability and corrosion resistance.

Another important problem associated with the high chromium ferritic stainless steels is their pronounced tendency for embrittlement during processing. The embrittlement causes the steels to crack during uncoiling, cold rolling and handling; and as a consequence, yields from ingot to finished product are often unacceptably low. The embrittlement of the high chromium ferritic stainless steels during processing is not well understood, but depending on circumstances has been related to carbon and nitrogen contents, to sigma phase formation, and to $\alpha_1 - \alpha_2$ phase separation. The latter phenomenon is commonly referred to as "885F embrittlement". It has now been discovered for steels of this invention that by using the production methods described hereinafter, the problems caused by the embrittlement can be avoided and product yields considerably improved.

An additional object of the present invention is, therefore, to provide processing methods whereby high chromium ferritic stainless steels can be manufactured with improved ingot yield.

These and other objects of the invention as well as a complete understanding thereof may be obtained from the following description and examples.

The present invention relates essentially to high chromium fully ferritic stainless steels characterized by high resistance to chloride stress corrosion cracking and good weldability, and having compositions which include, in weight percent, up to 0.04 carbon, up to 0.04 nitrogen, with the sum of carbon plus nitrogen content being below 0.07, up to 1.0 manganese, up to 1.0 silicon, 23.0 to 28.0 chromium, up to 0.50 nickel, up to 0.50 copper, up to 0.20 cobalt, up to 2.75 molybdenum, up to 0.70 columbium, up to 0.60 titanium, and the balance iron and incidental impurities. Within this broad compositional range, it is desirable to further restrict composition, as described below, to achieve specific combinations of chloride stress corrosion resistance, weldability, and other properties.

In accordance with the invention, if carbon and nitrogen are above the recited maximums, it is extremely difficult to prevent intergranular corrosion and a loss in toughness during processing. Morever, excessive amounts of carbon and nitrogen in the final annealed product reduce corrosion resistance by forming complex carbides or nitrides which deplete the matrix in chromium or act as possible sites for pit nucleation. In the columbium-stabilized stainless of this invention, carbon plus nitrogen in amounts above about 0.04% cause low melting constituents to form which cause cracking during welding. In the titanium-stabilized steels of this invention, carbon plus nitrogen contents above 0.07% increase the amounts of titanium needed for stabilization to such an extent that it is very difficult to produce strip or sheets with good surface quality. Moreover, carbon plus nitrogen contents below about 0.02% in the titanium-stabilized steels of this invention very substantially reduce weld formability.

Manganese is a common residual element which increases the strength of the invented steels, but does not significantly improve corrosion resistance or toughness. Manganese contents above the recited upper limit increase cost without improving properties.

Silicon is useful for increasing chromium recovery during melting and may slightly improve corrosion resistance. However, silicon above the recited upper limit reduces toughness and weld formability.

A minimum of 23% chromium is essential for good corrosion resistance, but in amounts above the recited upper limit it substantially increases the tendency for embrittlement during processing.

Nickel is a common residual element, but in amounts above the recited upper limit very substantially reduces stress corrosion resistance, especially for materials in the cold-worked condition.

Copper is a common residual element, but must be restricted to the recited upper limit to assure good resistance to chloride stress cracking, especially for materials in the cold-worked condition.

Cobalt is another common residual element. Cobalt significantly decreases stress corrosion cracking resistance, and in addition is undesirable in nuclear applications because of its tendency to form energetic long-lived radioactive isotopes. Cobalt in amounts above the recited upper limit is therefore undesirable.

Molybdenum is very useful for improving the corrosion resistance of the invented steels in chloride containing media, and for reducing the detrimental influences of copper and nickel on the chloride stress corrosion resistance of materials in the cold-worked condition. However, molybdenum substantially increases the tendency of the invented steels for embrittlement during heat treatment and processing, and must be restricted below the recited upper limit to avoid excessive difficulty in processing.

Columbium is useful for stabilizing the carbon and nitrogen contents of the invented steels and to thereby reduce their susceptibility to intergranular corrosion and embrittlement after welding or heat treatment. In titanium-free steels it is necessary that the minimum columbium content be at least eight times the carbon plus nitrogen content to assure good resistance to intergranular corrosion. When columbium is increased beyond the recited upper limit, excess columbium is present with the result that the invented steels become very susceptible to embrittlement during heat treatment or processing.

Titanium, like columbium, is useful for combining with the carbon and nitrogen contents of the invented steels and to thereby improve their resistance to intergranular corrosion and toughness after welding. In columbium-free steels it is necessary that the minimum titanium content be at least equal to six times carbon plus nitrogen content to assure good resistance to intergranular corrosion. If titanium is increased above the recited upper limit, excess titanium is present with the result that the invented steels become very susceptible to embrittlement during heat treatment or processing.

To illustrate the criticality of composition in the alloys of this invention, a large number of alloys were melted by various methods and tested for chloride stress corrosion, weldability and other properties. Table I gives the composition of these alloys and the method by which they were melted. The alloys prepared by vacuum-arc melting were melted using material from Coil 930594 as a base. Hence, their composition is essentially identical to that of Coil 930594, except for alloys such as NCC-3 and Cu-1 to which intentional additions of copper, nickel, titanium and other elements were made during melting.

TABLE I

COMPOSITION OF EXPERIMENTAL MATERIALS

A. Electron-Beam Melted Stainless Steels

| Material Code | C | Mn | P | S | Si | Ni | Cr | Mo | Cu | Co | Al | O | N | Other |
|---|---|---|---|---|---|---|---|---|---|---|---|---|---|---|
| 930593 | 0.0027 | <0.01 | 0.016 | 0.007 | 0.24 | 0.09 | 25.64 | 0.03 | 0.01 | 0.03 | 0.003 | 0.0010 | 0.008 | — |
| 930594 | 0.0025 | — | 0.01 | 0.007 | 0.27 | 0.11 | 26.99 | 0.97 | 0.01 | 0.03 | 0.003 | 0.0019 | 0.01 | — |
| 100641 | 0.002 | — | 0.016 | 0.009 | 0.18 | 0.13 | 26.59 | 1.24 | 0.01 | 0.03 | — | — | 0.01 | — |

B. Vacuum-Arc Melted Stainless Steels*

| Material Code | C | Mn | P | S | Si | Ni | Cr | Mo | Cu | Co | Al | O | N | Other |
|---|---|---|---|---|---|---|---|---|---|---|---|---|---|---|
| Cb-3 | 0.031 | — | — | — | — | — | — | — | — | — | — | 0.005 | 0.029 | — |
| Ti-1 | 0.0035 | — | — | — | — | — | — | — | — | — | — | 0.0059 | 0.009 | 0.18 Ti |
| Ti-6 | 0.005 | — | — | — | — | — | — | — | — | — | — | — | 0.009 | 0.28 Ti |
| Ti-2 | 0.0046 | — | — | — | — | — | — | — | — | — | — | 0.0040 | 0.009 | 0.33 Ti |
| Ti-3 | 0.029 | — | — | — | — | — | — | 1.06 | — | — | — | 0.0037 | 0.034 | 0.15 Ti |
| Ti-5 | 0.034 | — | — | — | — | — | — | — | — | — | — | 0.0032 | 0.028 | 0.41 Ti |
| Cb-1 | 0.0032 | — | — | — | — | — | — | — | — | — | — | 0.0063 | 0.006 | 0.33 Cb |
| Cb-2 | 0.003 | — | — | — | — | — | — | — | — | — | — | 0.0063 | 0.010 | 0.67 Cb |
| Cb-4 | 0.026 | — | — | — | — | — | — | 0.90 | — | — | — | 0.0033 | 0.032 | 0.31 Cb |
| Cb-5 | 0.034 | — | — | — | — | — | — | 1.03 | — | — | — | 0.0069 | 0.034 | 0.58 Cb |
| Mo-4 | 0.0045 | — | — | — | — | — | — | 1.85 | — | — | — | — | 0.011 | — |
| Cu-1 | 0.0027 | — | — | — | — | — | — | — | 0.32 | — | — | 0.0083 | 0.01 | — |
| Cu-2 | 0.015 | — | — | — | — | — | — | — | 1.04 | — | — | 0.0042 | 0.009 | — |
| NK-1 | 0.0022 | — | — | — | — | 1.14 | — | — | — | — | — | 0.0062 | 0.009 | — |
| Co-1 | 0.002 | — | — | — | — | — | — | — | — | 2.25 | — | — | 0.015 | — |
| NCC-1 | 0.033 | — | — | — | 0.26 | 0.38 | 25.56 | 0.99 | 0.16 | 0.15 | 0.16 | — | 0.017 | 0.38 Ti |
| NCC-3 | 0.025 | 0.23 | — | — | — | 0.12 | 25.29 | 1.05 | 0.03 | 0.03 | — | — | 0.019 | 0.32 Ti |
| NCC-4 | 0.024 | 0.23 | — | — | — | 0.21 | 25.62 | 0.95 | 0.04 | 0.01 | — | 0.0050 | 0.019 | 0.31 Ti |
| NCC-6 | 0.020 | 0.24 | — | — | 0.28 | 0.48 | 25.75 | 1.82 | 0.13 | 0.03 | — | 0.0050 | 0.013 | 0.43 Ti |

C. Vacuum-Induction Melted Stainless Steels

| Material Code | C | Mn | P | S | Si | Ni | Cr | Mo | Cu | Co | Al | O | N | Other |
|---|---|---|---|---|---|---|---|---|---|---|---|---|---|---|
| 3775 | 0.019 | 0.27 | 0.016 | — | 0.32 | 0.22 | 26.37 | 0.95 | 0.13 | <0.01 | 0.02 | 0.0155 | 0.013 | 0.43 Ti |
| 3780 | 0.018 | 0.28 | 0.017 | — | 0.38 | 0.23 | 25.91 | 0.98 | 0.13 | <0.01 | 0.05 | 0.0118 | 0.029 | 0.56 Ti |
| 3776A | 0.021 | 0.28 | 0.02 | 0.013 | 0.55 | 0.22 | 26.09 | 1.81 | 0.12 | 0.03 | — | — | 0.026 | 0.45 Ti |
| 3779 | 0.036 | 0.29 | 0.018 | — | 0.45 | 0.23 | 25.64 | 1.88 | 0.12 | <0.01 | 0.06 | 0.008 | 0.027 | 0.63 Ti |
| 3778A | 0.03 | 0.29 | 0.018 | 0.012 | 0.45 | 0.22 | 26.20 | 1.91 | 0.12 | <0.01 | — | — | 0.026 | 0.25 Ti, |

TABLE I-continued

COMPOSITION OF EXPERIMENTAL MATERIALS

A. Electron-Beam Melted Stainless Steels

| Material Code | C | Mn | P | S | Si | Ni | Cr | Mo | Cu | Co | Al | O | N | Other |
|---|---|---|---|---|---|---|---|---|---|---|---|---|---|---|
| 3777 | 0.024 | 0.29 | 0.023 | — | 0.46 | 0.21 | 25.63 | 2.69 | 0.13 | <0.01 | 0.04 | 0.0119 | 0.029 | 0.29 Cb 0.41 Ti |
| 3777A | 0.032 | 0.28 | 0.023 | 0.013 | 0.47 | 0.24 | 25.96 | 2.67 | 0.13 | <0.01 | — | — | 0.031 | 0.45 Ti |

D. Electric-Furnace Melted Stainless Steels

| Material Code | C | Mn | P | S | Si | Ni | Cr | Mo | Cu | Co | Al | O | N | Other |
|---|---|---|---|---|---|---|---|---|---|---|---|---|---|---|
| Coil 125108 | 0.019 | 0.32 | 0.015 | 0.004 | 0.08 | 0.40 | 25.87 | 1.04 | 0.10 | 0.03 | 0.13 | 0.015 | 0.03 | 0.24 Ti |
| Coil 961191 | 0.05 | 1.75 | 0.031 | 0.015 | 0.56 | 12.18 | 16.24 | 2.18 | 0.17 | 0.14 | — | — | — | — |

*Melted using material from Coil 930594 as a base.

The mechanism of stress corrosion cracking in stainless steels, and especially for ferritic stainless steels, is not well understood. However, it is observed that in chloride-containing environments stainless steels often develop cracks and fail at stresses far below that predicted on the basis of their normal tensile strength. The stresses promoting such failures may be external, for example those resulting from applied loads, or internal, for example those resulting from cold working or differential expansion and contraction during heat treatment or welding. Tests to evaluate the susceptibility of stainless steels to stress corrosion cracking are most commonly made in boiling magnesium chloride, which provides conditions highly conducive to such failures. U-bend specimens of some of the alloys listed in Table I were therefore made and exposed in boiling 45% magnesium chloride (154°C). In this test the time required to induce cracking is used as a measure of stress corrosion cracking resistance.

The U-bend specimens were formed by bending ½ in. wide by 0.060 in. thick by 5 in. long strips over a ½ in. diameter mandrel and by inserting the ends of the parallel legs in a slotted block to prevent springback. The strip used in the U-bends was specially processed (e.g. water quenched, etc.) during annealing to prevent intergranular corrosion caused by intergranular carbide or nitride precipitation. The ASTM grain size of the strip ranged from 6 to 8. Specimens were formed from annealed strip and from strip which after annealing had been cold deformed 30% by rolling. The tests on cold deformed strip were included so as to evaluate the influence of the internal stresses resulting from severe cold forming. In this respect, the degree of internal stress induced by cold rolling up to a reduction of 30% is critical, since materials are rarely deformed in excess of this amount by the forming operations carried out prior to service. The stress corrosion resistance of materials deformed to this extent is therefore an important index of their behavior.

TABLE II

STRESS CORROSION RESISTANCE OF U-BEND SPECIMENS IN BOILING 45% MAGNESIUM CHLORIDE (154°C)*

| Material Code | Specimen Code | Nickel Content | Copper Content | Cobalt Content | Molybdenum Content | Titanium Content | Time to failure in the Indicated Conditions — Hrs. Annealed | 30% Cold-rolled |
|---|---|---|---|---|---|---|---|---|
| 930593 | 1 | 0.09 | 0.01 | 0.03 | 0.03 | N.A. | >285 | >266 |
| 930594 | 1 | 0.11 | 0.01 | 0.03 | 0.97 | N.A. | >308 | — |
| Mo-4 | 1 | 0.11 | 0.01 | 0.03 | 1.85 | N.A. | >385 | >415 |
| NCC-3 | 1 | 0.13 | 0.03 | 0.03 | 1.05 | 0.32 | >423 | >423 |
| | 2 | | | | | | | >370 |
| NCC-4 | 1 | 0.21 | 0.04 | 0.02 | 0.95 | 0.31 | >236 | 190 (Failed) |
| 3780 | 1 | 0.23 | 0.13 | 0.01 | 0.98 | 0.56 | >515 | >43 (Failed) |
| | 2 | | | | | | >502 | >43 (Failed) |
| 3776A | 1 | 0.22 | 0.12 | 0.03 | 1.81 | 0.45 | >502 | >387 |
| 3777A | 1 | 0.22 | 0.12 | 0.01 | 2.67 | 0.45 | >521 | >414 |
| Cu-1 | 1 | 0.11 | 0.32 | 0.03 | 0.97 | N.A. | >233 | 19 (Failed) |
| | 2 | | | | | | | 19 (Failed) |
| 125108 | 1 | 0.39 | 0.10 | 0.03 | 1.04 | 0.24 | 22 (Failed) | 40 (Failed) |
| | 2 | | | | | | >276 | 40 (Failed) |
| | 3 | | | | | | 65 (Failed) | — |
| | 4 | | | | | | >258 | — |
| NCC-1 | 1 | 0.38 | 0.16 | 0.15 | 0.99 | 0.38 | — | 19 (Failed) |
| | 2 | | | | | | | <66 (Failed) |
| NCC-6 | 1 | 0.48 | 0.13 | 0.03 | 1.83 | 0.43 | — | 19 (Failed) |
| | 2 | | | | | | | <66 (Failed) |
| NK-1 | 1 | 1.14 | 0.01 | 0.03 | 1.18 | N.A. | 17 (Failed) | — |
| CU-2 | 1 | 0.11 | 1.04 | 0.03 | 0.97 | N.A. | 21 (Failed) | — |
| Co-1 | 1 | 0.11 | 0.01 | 2.25 | 0.97 | N.A. | 65 (Failed) | — |
| | 2 | | | | | | 65 (Failed) | |

*U-bends formed from annealed Type 316 stainless (Coil 961191) failed in this test after an exposure of 17 hours.
N.A. — Not added.

Table II gives the results of the stress corrosion tests. It is clear from the data that the chloride stress corrosion resistance of the high chromium ferritic stainless steels is critically affected by nickel, copper and cobalt content. The detrimental effects of nickel and copper are roughly equivalent and substantially greater than that of cobalt, as is shown by the comparative behavior of the U-bend specimens made from Alloys Co-1 (2.25% Co), NK-1 (1.14% Ni) and Cu-2 (1.04% Cu).

To obtain good resistance to stress corrosion with the alloys of this invention in the annealed or slightly cold-worked condition, the maximum tolerable nickel plus copper content at low cobalt content (e.g., below about 0.20%) is about 0.50%. This criticality is illustrated in Table II by the U-bend specimens formed from annealed samples of Coil 125108 (0.50% nickel plus copper) which on one hand failed in test times as short as 22 hours, and on the other hand did not fail in test times exceeding 250 hours, and by the fact that none of the U-bends formed from the annealed alloys containing less than 0.50% nickel plus copper failed in testing.

The data in Table II also show that the internal or residual stresses introduced by severe cold work (e.g., cold rolled 30%) substantially reduce the chloride stress corrosion resistance of the alloys of this invention. The detrimental effect of internal stress is clearly shown by the comparative behavior of the U-bend specimens formed from the annealed and from the 30% cold rolled samples of Alloys 3780 and Cu-1. The U-bends formed from the annealed samples of these alloys resisted cracking for over 200 hours, whereas those formed from the cold-rolled samples failed in less than 43 hours. Reducing the copper and nickel and increasing the molybdenum contents of the alloys of this invention improves their resistance to chloride stress corrosion cracking in the heavily cold worked condition. To obtain good resistance with the alloys containing about 1% molybdenum in the heavily cold worked condition, the maximum tolerable nickel plus copper content is about 0.30%. This criticality is evidenced by the U-bend specimens of the cold-rolled material from Alloy NCC-4 (0.25% nickel plus copper) which showed good stress corrosion resistance with no cracking up to 190 hours; whereas, the U-bend specimens of the cold-rolled material from Alloy 3780 (0.36% nickel plus copper) showed poor resistance and failed in only 43 hours. Based on the comparative behavior of Alloys 3780, 3776A and 3777A, increasing molybdenum content improves stress corrosion cracking resistance in the cold-rolled alloys of this invention and, in effect, reduces the criticality of nickel and copper content. Mathematical treatment of stress corrosion data for cold-rolled alloys shows that to obtain good resistance to chloride stress corrosion with the alloys of this invention in the heavily cold deformed condition, it is essential that the nickel plus copper content in relation to the molybdenum and cobalt content be no greater than the amount given by the following equation:

$$8\,(\%Ni + \%\,Cu) - 1.5 = \%\,Mo$$

Stainless steel weldments exposed in environments common to the chemical, pulp and paper, and like industries, are often subject to intergranular corrosion caused by intergranular carbide or nitride precipitation. In the case of the conventional austenitic stainless steels, lowering carbon content to about 0.025%, as with AISI Type 304L, or adding titanium or columbium, as with AISI Types 321 and 347, are practical and effective countermeasures. Lowering the carbon and nitrogen contents of the high chromium ferritic stainless steels is also effective, but the amounts of carbon and nitrogen needed to obtain immunity to intergranular corrosion are extremely low and very difficult or costly to obtain by current production methods. Titanium or columbium stabilization is a more practical solution, but as will be shown hereinafter, the necessary amounts of titanium or columbium to improve the intergranular corrosion resistance of the ferritic stainless steels of this invention are substantially different in relation to carbon and nitrogen content than in the conventional austenitic stainless steels such as Types 321 and 347. The commonly accepted minimums for titanium in Type 321 and for columbium in Type 347 are five and ten times the carbon content, respectively.

The susceptibility of the ferritic stainless steels of this invention to intergranular corrosion after welding (weld decay) was evaluated in an aqueous solution containing 10% nitric acid and 3% hydrofluoric acid at 70°C. Procedure for the test is given in ASTM Standard A262-70. The test specimens were prepared from 0.060 in. thick TIG welds prepared from the alloys listed in Table I. The susceptibility of the welds to intergranular corrosion was rated microscopically according to the severity and location of the corrosion in the weldments.

TABLE III

CORROSION RESISTANCE OF TIG WELDS (0.060 IN.) IN 10% $HNO_3$-3% HF (70°C)*

| Material Code | Carbon Content | Nitrogen Content | Molybdenum Content | Other | Corrosion Severity in Indicated Location: Weld metal | Weld Line | Heat-Affected Zone |
|---|---|---|---|---|---|---|---|
| 930594 | 0.0025 | 0.01 | 0.97 | — | None | None | Light |
| Mo-1 | 0.002 | 0.009 | 1.90 | — | None | None | Light |
| Mo-2 | 0.0024 | 0.012 | 2.50 | — | None | None | Trace |
| Ti-1** | 0.0035 | 0.009 | ** | 0.18 Ti | None | None | None |
| Cb-1** | 0.0032 | 0.006 | ** | 0.33 Cb | None | None | None |
| CB-3** | 0.031 | 0.029 | ** | — | Severe | Severe | Severe |
| Ti-3** | 0.029 | 0.034 | ** | 0.15 Ti | Severe | Severe | Severe |
| Ti-5** | 0.034 | 0.028 | ** | 0.41 Ti | None | None | None |
| Cb-4** | 0.026 | 0.032 | ** | 0.31 Cb | Severe | Severe | Severe |
| Cb-5** | 0.034 | 0.034 | ** | 0.58 Cb | None | None | None |
| 125108 | 0.019 | 0.03 | 1.04 | 0.24 Ti | None | Trace | None |
| 3780 | 0.018 | 0.029 | 0.98 | 0.56 Ti | None | None | None |
| 3776A | 0.021 | 0.026 | 1.81 | 0.45 Ti | None | None | None |
| 3778A | 0.03 | 0.026 | 1.91 | 0.25 Ti, 0.29 Cb | None | None | None |
| 3777 | 0.024 | 0.029 | 2.69 | 0.41 Ti | None | None | None |

*Severity of corrosion rated according to the location in the weldment. Test time — 4 hours.
**Molybdenum content of these alloys similar to that of Coil 930594.

The weld corrosion data in Table III clearly show that the unstabilized ferritic stainless steels of this invention are susceptible to intergranular corrosion after welding. The susceptibility is greatly reduced, however, by lowering carbon and nitrogen content, as is evidenced by the comparative behavior of Alloy Cb-3 (0.06% carbon plus nitrogen) which exhibited severe weld corrosion and Coil 930594 (0.012% carbon plus nitrogen) which showed only slightly weld attack. The weld corrosion data also show that titanium and columbium, used singly or in combination, substantially improve the resistance of the steels of this invention to intergranular corrosion after welding. The beneficial effect of titanium is clearly shown by the weld corrosion data for Alloys Cb-3, Ti-3, Ti-5, and Coil 125108 which contain from about 0.05 to 0.06% carbon plus nitrogen. Alloy Cb-3 developed severe weld attack as did Alloy Ti-3 which contains an amount of titanium (0.15%) equal to five times the carbon content in accord with the commercial practice for Type 321 stainless. Coil 125108 contains an amount of titanium equal to about five times the carbon plus nitrogen content and still shows slight weld attack, indicating that the minimum amount of titanium needed to achieve good resistance to weld decay in the steels of this invention is considerably greater than five times the carbon content and even greater than five tims the carbon plus nitrogen content. Alloy Ti-5 which contained an amount of titanium (0.41%) almost equal to six times the carbon plus nitrogen content showed no weld attack whatsoever.

The beneficial effect of columbium on the weld corrosion of the alloys of this invention is illustrated by Alloys Cb-4 and Cb-5, which have fairly similar carbon and nitrogen, but different columbium contents. Alloy Cb-4, which contains an amount of columbium (0.31%) somewhat greater than ten times the carbon content in accord with the requirements for Type 347 stainless, showed severe weld corrosion. In comparison, Alloy Cb-5, which contains an amount of columbium (0.58%) slightly greater than eight times the carbon plus nitrogen content, showed no weld corrosion.

The weld corrosion data in Table III, and in particular for Alloy 3778A, confirm that columbium in combination with titanium may be used to prevent weld corrosion. Such a combination is useful for reducing the amount of titanium needed for stabilization and to thereby reduce the likelihood of obtaining objectionable surface defects caused by titanium inclusions, and for reducing the amount of columbium needed for stabilization and to thereby reduce the risk of cracking in welding. In order to obtain good resistance to weld corrosion after welding with the alloys stabilized by both titanium and columbium, the amounts of these elements must at least be equal to those given by the following relationship:

$$\frac{\%Ti}{6} + \frac{\%Cb}{8} = (\%C + \%N)$$

Finally, the corrosion resistance of the welds from Alloys Mo-1 and Mo-2 shows that increasing the molybdenum content of the steels of this invention improves their resistance to weld decay at low levels of carbon and nitrogen.

In addition to having good resistance to corrosion after welding, fully weldable stainless steels must also exhibit good resistance to cracking during weldingg and in subsequent forming operations. To illustrate the criticality of composition in the ferritic stainless steels of this invention with respect to cracking during welding, 0.060 in. thick TIG welds were made without filler metal in several of the alloys listed in Table I using different heat inputs and examined microscopically for unsoundness. The welds of all the nonstabilized alloys, as for example Coil 930594 and Alloy Cb-3, and the titanium-stabilized alloys, for example Alloys Ti-5 and 3775, were completely crack-free for every weld condition used. However, the welds of the columbium-stabilized alloys containing more than about 0.04% carbon plus nitrogen, developed severe cracking. For example, Alloy Cb-5, which contains 0.068% carbon plus nitrogen and 0.58% columbium, showed catastrophic centerline cracking; whereas, Alloy Cb-2, which contains 0.013% carbon plus nitrogen and 0.67% columbium, showed no cracking whatsoever. Thus, to avoid weld cracking with the columbium-stabilized ferritic stainless steels of this invention, it is essential that the carbon plus nitrogen content be below 0.04%. Higher carbon plus nitrogen contents are only permissible in the columbium-stabilized steels of this invention when titanium is also present, as demonstrated by Alloy 3778A.

TABLE IV

OLSEN CUP DUCTILITY OF THE INVENTED ALLOYS IN THE WELDED AND IN THE ANNEALED CONDITION (0.060 IN. THICK)

| Material Code | Carbon Content | Nitrogen Content | Other | Olsen Cup Height-In.* As-Welded | As-Annealed |
|---|---|---|---|---|---|
| 930594 | 0.0025 | 0.01 | — | 0.420 0.424 | 0.418 |
| Cb-3 | 0.031 | 0.029 | — | 0.020 | 0.360 |
| Ti-1 | 0.0035 | 0.009 | 0.18 Ti | 0.250 | 0.400 |
| Ti-6 | 0.0053 | 0.009 | 0.28 Ti | 0.185 | |
| Ti-3 | 0.029 | 0.034 | 0.15 Ti | 0.040 | 0.370 |
| Ti-5 | 0.034 | 0.28 | 0.41 Ti | 0.420, 0.360 | 0.400 |
| 3775 | 0.019 | 0.013 | 0.43 Ti | 0.430, 0.440 | 0.420 |
| 3780 | 0.018 | 0.029 | 0.56 Ti | 0.300, 0.320 | 0.400 |
| Cb-1 | 0.0032 | 0.006 | 0.33 Cb | 0.390, 0.440 | 0.420 |
| Cb-2 | 0.003 | 0.01 | 0.67 Cb | 0.410 | 0.400 |
| Cb-4 | 0.026 | 0.032 | 0.31 Cb | 0.066 | 0.380 |
| Cb-5** | 0.034 | 0.034 | 0.58 Cb | 0.080 | 0.400 |
| 3778A | 0.03 | 0.026 | 0.25 Ti, 0.29 Cb | 0.400, 0.413 | 0.410 |

*Maximum cup height obtained without cracking.
**Contained cracks in the as-welded condition.

The weld formability of the ferritic stainless steels of this invention was evaluated by making Olsen cup tests on some of the 0.060 in. thick TIG welds prepared for the weld cracking studies and by comparing the results to similar tests made on the unwelded base materials. The results are given in Table IV. The data confirm the well-known fact that lowering the carbon plus nitrogen content of the high chromium stainless steels substantially improves weld ductility and toughness. The Olsen cup ductility of Coil 930594, for example, which contains only 0.012% carbon plus nitrogen was equivalent to that of the annealed base material; whereas, that of Alloy Cb-3, which contains 0.06% carbon plus nitrogen, was very poor and considerably less than that of the annealed base material. More importantly, the Olsen cup data show that titanium additions in the amount required to minimize weld corrosion, that is, when titanium is present in quantities at least equal to six times the carbon plus nitrogen content, substantially improve the weld formability of the nonstabilized alloys when their carbon plus nitrogen contents are above about 0.02%. The beneficial effect of titanium stabilization, in this respect, is clearly shown by the differences in the cup height of the welds made in Alloys Cb-3, 3775 and Ti-5. Titanium stabilization of the alloys containing less than about 0.02% carbon plus nitrogen impairs weld ductility, as is evidenced by the relatively poor Olsen cup ductility of the welds made in Alloys Ti-1 and Ti-6. Columbium additions in the amounts needed to minimize weld corrosion, that is, when present in amounts at least equal to eight times the carbon plus nitrogen content, do not reduce weld formability in the alloys containing less than about 0.04% carbon plus nitrogen, as is evidenced by the comparatively good Olsen cup ductility of Alloys Cb-1 and Cb-2. However, columbium stabilization of the alloys containing more than about 0.04% carbon produces cracking during welding; and as would be expected, the weld formability of such alloys is extremely poor. Stabilization by both columbium and titanium at carbon plus nitrogen levels above 0.04% improves weld formability, as is evidenced by the good cup ductility of the welds made in Alloy 3778A, which contains 0.056% carbon plus nitrogen, 0.25% titanium and 0.29% columbium.

The ferritic stainless steels of this invention may be made by any of the well-known methods used in the production of nonhardening corrosion-resisting steels. However, unless special precautions are used in processing, product yields are unacceptably low because of low toughness related to carbon and nitrogen or 885°F embrittlement, and physical properties, especially toughness and stress corrosion resistance, are not optimum. The ferritic stainless steels of this invention are best produced by hot rolling ingots to slab and then conditioning the slabs by grinding with the slabs at temperatures in the range of 400° to 1000°F to remove surface defects. Conditioning in this temperature range is essential to avoid cracks produced by the stresses introduced by grinding. The slabs after conditioning are then best reheated to hot rolling temperature without allowing them to cool much below 400°F. Slab reheating temperatures are best controlled between 1800° and 2100°F, since significantly higher reheating temperatures cause excessive grain growth which promotes embrittlement of the hot band, and since significantly lower temperatures substantially increase mill loads. Hot band thickness is best maintained between 0.060 in. and 0.180 in., because at larger thickness the toughness of the hot band becomes substantially poorer, and because at lower thicknesses there is insufficient material to allow for surface improvement by cold rolling. Most coils of hot band produced from the conditioned slabs of the invented steels can be handled in the as-hot-rolled condition at ambient temperatures, although to guarantee freedom from cracking during uncoiling or other operations incident to continuous or strand annealing, they are best uncoiled at temperatures between 400° and 1000°F. Experimental notch-toughness data illustrating the benefit of this approach are shown in TABLES V and VI for embrittled hot band material from Coil 100641 and Alloy 3780. It is clear from the data that the notch toughness of slowly cooled hot band of these two steels is much higher at temperatures above 400°F (e.g. 500°F) than at ambient temperature.

TABLE V

SUBSIZE CHARPY IMPACT PROPERTIES OF SLOWLY COOLED HOT BAND (0.110-0.120 IN.) FROM ALLOY 3780*

| | Test Temperature—75F | | | Test Temperature 500F | |
|---|---|---|---|---|---|
| Quenching Temp. °F | Impact Energy ft-lb | Fracture Appearance | Hardness $R_b$ | Impact Energy ft-lb | Fracture Appearance |
| 1800 | 9.75 | Ductile/Brittle | 82 | 24 | Ductile |
| 1600 | 9.75 | Ductile | 80 | — | — |
| 1500 | 6.75 | Ductile | 83 | 25.75 | Ductile |
| 1400 | 4.0 | Ductile/Brittle | 81 | 25.75 | Ductile |
| 1300 | 3.75 | Brittle | 83 | 25.75 | Ductile |
| 1200 | 4.5 | Brittle | 83 | 25.25 | Ductile |
| 1100 | 3.25 | Brittle | 84 | 25.5 | Ductile |
| 1000 | 2.0 | Brittle | 84 | 23.75 | Ductile |
| 900 | 0.75 | Brittle | 95 | 17.0 | Ductile |
| 800 | 0.75 | Brittle | 94 | 16.75 | Ductile |

*Specimens held for ½ hr. at 1800°F, then furnace-cooled at a rate of 50°F/hr. to indicated temperature and water-quenched.

TABLE VI

SUBSIZE CHARPY IMPACT PROPERTIES OF SLOWLY COOLED MATERIAL (0.120 IN.) FROM COIL 100641*

| Quenching Temp. °F | Test Temperature — 75F Lateral Expansion In. | Fracture Appearance | Hardness $R_b$ | Test Temperature — 500F Impact Energy ft-lb | Fracture Appearance |
|---|---|---|---|---|---|
| 1800 | 0.053 | Ductile | 83 | 40.0 | Ductile |
| 1600 | 0.052 | Ductile | 83 | 46.25 | Ductile |
| 1500 | 0.058 | Ductile | 83 | 44.5 | Ductile |
| 1400 | 0.008 | Brittle | 80 | 40.0 | Ductile |
| 1300 | 0.015 | Ductile/Brittle | 80 | 36.25 | Ductile |
| 1200 | 0.016 | Ductile/Brittle | 80 | 36.5 | Ductile |
| 1100 | 0.014 | Ductile/Brittle | 78 | 32.75 | Ductile |
| 1000 | 0.004 | Brittle | 82 | 38.25 | Ductile |
| 900 | 0.001 | Brittle | 92 | — | — |
| 800 | 0.001 | Brittle | 93 | 26.5 | Ductile |

*Specimens held for ½ hr. at 1800°F, then furnace-cooled at a rate of 50°F/hr. to indicated temperature and water-quenched.

Subsequent to the annealing and pickling of the hot-rolled band, the steels of this invention may be directly cold rolled to final gage with or without intermediate annealing. However, to obtain optimum properties it is essential that the final annealing temperature be maintained between 1400° and 1600°F. Higher annealing temperatures cause excessive grain growth which reduces toughness and lowers stress corrosion resistance, whereas lower annealing temperatures do not produce sufficient recrystallization. The steels of the invention, after the final annealing and pickling operations, may thereafter be fabricated into any desired component, for example a component of a heat exchanger, and in particular condenser tubing.

TABLE VII

PITTING RESISTANCE OF EXPERIMENTAL ALLOYS IN 0.1N HCl CONTAINING 10% $FeCl_3 \cdot 6H_2O$*

| Material Code | Molybdenum Content | Other | Severity of Pitting at Indicated Test Temperature** 40°C | 60°C |
|---|---|---|---|---|
| 930593 | 0.03 | — | Severe | Severe |
| 930594 | 0.97 | — | Light | Severe |
| 3780 | 0.98 | 0.56 Ti | Moderate | Severe |
| 3776A | 1.81 | 0.45 Ti | None | Severe |
| 3777A | 2.67 | 0.41 Ti | None | Light |
| 961191*** | 2.18 | — | Severe | Severe |

*Testing time — 24 hrs.
**Pitting attack rated visually as none, light, moderate, severe.
***Commercial Type 316 stainless.

TABLE VIII

PITTING RESISTANCE OF EXPERIMENTAL ALLOYS IN NEUTRAL SYNTHETIC SEAWATER CONTAINING 1% $K_3Fe(CN)_6$=

| Material Code | Molybdenum Content | Other | Severity of Pitting at Indicated Test Temperature** 40°C | 60°C |
|---|---|---|---|---|
| 930593 | 0.03 | — | Moderate | Severe |
| 930594 | 0.97 | — | None | Moderate |
| 3780 | 0.98 | 0.56 Ti | None | Moderate |
| 3776A | 1.81 | 0.45 Ti | None | Light |
| 3777 | 2.67 | 0.41 Ti | None | None |
| 961191*** | 2.18 | — | Light | Severe |

*Testing time — 24 hrs.
**Pitting attack rated visually as none, light, moderate and severe.
***Commercial Type 316 stainless.

The ferritic stainless steels of this invention offer an excellent combination of weldability, pitting and stress corrosion resistance heretofore unavailable with conventional stainless steels, and are therefore particularly well suited for applications in the chemical, pulp and paper, petrochemical, desalination, nuclear power and like industries. Furthermore, the new steels are essentially nickel free and therefore considerably more economical than chromium-nickel stainless steels. AISI Type 316 stainless steel sheet, strip and tubing are widely used in the above industries because of the high resistance of the alloy to pitting in chloride-containing environments, and would be even more widely used were the alloy more resistant to chloride-stress corrosion. The marked superiority of the alloys of this invention over Type 316 with respect to both pitting and stress corrosion, and hence their particular suitability for application in the above-mentioned industries, is demonstrated by the stress corrosion data in Table II and by the pitting corrosion data in Tables VII and VIII. The data in Table II show that annealed U-bend specimens of Type 316 stainless from Coil 961191 fail in boiling magnesium chloride in less than 24 hours, whereas those from the alloys of the invention are completely resistant to cracking in the same media for testing periods as long as 516 hours. The pitting corrosion data in Table VII and VIII show that the pitting resistance of the alloys of this invention, particularly those containing 1% or more molybdenum, is superior to that of Type 316 in both acid and neutral chloride-containing media. The data in Tables VII and VIII were obtained by performing immersion tests for 24 hours at 40° and 60°C in 0.1N HCl containing 10% $FeCl_3 . 6H_2O$ and in neutral synthetic seawater containing 1% $K_3Fe(CN)_6$.

We claim:

1. A fully ferritic stainless steel welded article with high resistance to chloride stress corrosion, especially in the cold-worked condition, and high resistance to intergranular corrosion in combination with good weld formability, said entire welded article consisting essentially of, in weight percent, 0.003 to 0.04 carbon; 0.003 to 0.04 nitrogen, the sum of the carbon plus nitrogen content being below 0.04; up to 1.0 manganese; up to 1.0 silicon; 23.0 to 28.0 chromium; up to 0.50 nickel; up to 0.50 copper, the sum of the nickel and copper content being below 0.50; up to 0.20 cobalt; up to 2.75 molybdenum; 0.05 to 0.70 columbium, with columbium being at least equal to eight times the carbon plus nitrogen content; and the balance iron and incidental impurities, said welded article having an as-welded Olsen cup height exceeding 0.250 in. at a thickness of 0.060 in.

2. The fully ferritic stainless steel welded article of claim 1, wherein the sum of the nickel and copper content in relation to the molybdenum content is no greater than the amount given by the following equation:

$$8(\%Ni + \%Cu) - 1.5 = \%Mo.$$

3. A fully ferritic stainless steel welded article with high resistance to chloride stress corrosion cracking especially in the cold-worked condition, and high resistance to intergranular corrosion in combination with good weld formability, said entire welded article consisting essentially of, in weight percent, up to 0.04 carbon; up to 0.04 nitrogen, with the sum of the carbon and nitrogen content being above 0.02 but below 0.07; up to 1.0 manganese; up to 1.0 silicon; 23.0 to 28.0 chromium; up to 0.50 nickel; up to 0.50 copper, the sum of the nickel and copper content being below 0.50; up to 0.20 cobalt; up to 2.75 molybdenum; 0.12 to 0.60 titanium, with titanium being at least equal to six times the carbon plus nitrogen content; and the balance iron and incidental impurities, said welded article having an as-welded Olsen cup height exceeding 0.250 in. at a thickness of 0.060 in.

4. The fully ferritic stainless steel welded article of claim 3 wherein the sum of the nickel plus copper content in relation to the molybdenum content is no greater than the amount given by the following equation:

$$8(\%Ni + \%Cu) - 1.5 = \%Mo.$$

5. A fully ferritic stainless steel welded article with high resistance to chloride stress corrosion especially in the cold-worked condition, and high resistance to intergranular corrosion in combination with good weld formability, said entire welded article consisting essentially of, in weight percent, up to 0.04 carbon; up to 0.04 nitrogen, with the sum of the carbon plus nitrogen content being above 0.02 but below 0.07; up to 1.0 manganese; up to 1.0 silicon; 23.0 to 28.0 chromium; up to 0.50 nickel; up to 0.50 copper, with the sum of the nickel and copper content being below 0.50; up to 0.20 cobalt; up to 2.75 molybdenum; up to 0.30 titanium; up to 0.30 columbium, with the columbium and titanium contents at least being equal to the amounts given by the following equation:

$$\frac{\%Ti}{6} + \frac{\%Cb}{8} = (\%C + \%N)$$

and the balance iron and incidental impurities, said welded article having an as-welded Olsen cup height exceeding 0.250 in. at a thickness of 0.060 in.

6. The fully ferritic stainless steel welded article of claim 5 wherein the sum of the nickel plus copper content in relation to the molybdenum content is no greater than the amount given by the following equation:

$$8(\%Ni + \%Cu) - 1.5 = \%Mo.$$

* * * * *

UNITED STATES PATENT OFFICE

CERTIFICATE OF CORRECTION

Patent No. 3,957,544 Dated May 18, 1976

Inventor(s) Kenneth E. Pinnow and Jerome P. Bressanelli

It is certified that error appears in the above-identified patent and that said Letters Patent are hereby corrected as shown below:

Columns 5 and 6, Table I-continued, the heading "A. Electron-Beam Melted Stainless Steels" should read --C. Vacuum-Induction Melted Stainless Steels--;

Columns 5 and 6, Table II, the Molybdenum Content for Material Code NCC-6 should be --1.82-- instead of "1.83";

Column 10, Table IV, for Material Code Ti-6, in the As-Annealed column "0.400" should be inserted;

Column 13, Table VIII, in the heading the symbol "=" should be changed to --*--.

Signed and Sealed this

Twentieth Day of July 1976

[SEAL]

*Attest:*

RUTH C. MASON
*Attesting Officer*

C. MARSHALL DANN
*Commissioner of Patents and Trademarks*

Notice of Adverse Decision in Interference

In Interference No. 100,122, involving Patent No. 3,957,544, K. E. Pinnow and J. P. Bressanelli, FERRITIC STAINLESS STEELS, final judgment adverse to the patentees rendered June 19, 1980, as to claims 3 and 5.

[*Official Gazette September 30, 1980.*]